United States Patent [19]

Ishii

[11] Patent Number: 4,724,802

[45] Date of Patent: Feb. 16, 1988

[54] VALVE MECHANISM FOR AN AUTOMOTIVE ENGINE

[75] Inventor: Norio Ishii, Hachioji, Japan

[73] Assignee: Fuji Jukogyo Kabushiki Kaisha, Tokyo, Japan

[21] Appl. No.: 6,501

[22] Filed: Jan. 21, 1987

[30] Foreign Application Priority Data

Jan. 29, 1986 [JP] Japan ..... 61-17271

[51] Int. Cl.[4] ..... F01L 1/18; F02D 13/02

[52] U.S. Cl. ..... 123/90.16; 123/90.39; 123/90.44; 123/198 F

[58] Field of Search ..... 123/90.15, 90.16, 90.39, 123/90.44, 198 F

[56] References Cited

U.S. PATENT DOCUMENTS

| | | | |
|---|---|---|---|
| 4,182,289 | 1/1980 | Nakajima et al. | 123/90.16 |
| 4,353,334 | 10/1982 | Neitz | 123/90.16 |
| 4,429,853 | 2/1984 | Chaffotte et al. | 123/198 F |
| 4,448,156 | 5/1984 | Henault | 123/198 F |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,556,025 | 12/1985 | Morita | 123/90.16 |
| 4,612,884 | 9/1986 | Ajiki et al. | 123/90.44 |
| 4,656,977 | 4/1987 | Nagahiro et al. | 123/90.44 |

FOREIGN PATENT DOCUMENTS

| | | | |
|---|---|---|---|
| 57-193905 | 12/1982 | Japan . | |
| 58-22402 | 2/1983 | Japan . | |
| 58-98407 | 7/1983 | Japan . | |
| 243309 | 12/1985 | Japan | 123/90.39 |

*Primary Examiner*—Ira S. Lazarus

*Attorney, Agent, or Firm*—Martin A. Farber

[57] ABSTRACT

A valve mechanism has a rocker arm comprising a rocker arm member rocked by a cam and an actuating arm member operatively engaged with the rock arm member for operating a stem of a valve. A sleeve is rotatably and slidably mounted on a rocker-arm shaft. The rocker arm member is slidably engaged with splines of the sleeve, and the actuating arm member has splines corresponding to the splines of the sleeve and is slidably engaged with a cylindrical portion of the sleeve. A pistion is slidably mounted on the rocker-arm shaft adjacent the sleeve, and shifted to shift the sleeve to engage the splines thereof with the actuating member. The sleeve is held by a stopper at a disengagement position and an engagement position with the actuating arm member respectively.

4 Claims, 14 Drawing Figures

VALVE MECHANISM FOR AN AUTOMOTIVE ENGINE

BACKGROUND OF THE INVENTION

The present invention relates to a valve mechanism for an automotive engine, and more particularly to a valve mechanism provided with a shaft-mounted rocker arm of a divided type.

Such a valve mechanism is disclosed in Japanese Utility Model Application Laid Open Nos. 57-193905, 58-22402, and 58-98407, in which a valve mechanism is provided with a rocker arm divided into an actuating arm member for operating a valve and a rocker arm member to be rocked by a cam. The rocker arm member is adapted to be engaged with the actuating arm member for operating the valve.

As shown in FIGS. 11 to 14, a conventional valve mechanism comprises a rocker-arm shaft 31, a sleeve 32 slidably mounted on the shaft 31. The sleeve 32 has a plurality of splines 32*a* and projections 32*b* formed between splines 32*a*. A groove 32*c* is formed on the projections 32*b*. An actuating arm 33 mounted on the shaft 31 has a plurality of splines 33*a* corresponding to the projections 32*b* of the sleeve 32 to be detachably engaged therewith. A rocker arm member 34 provided to be engaged with a cam 40 mounted on a camshaft is mounted on the sleeve 32. The rocker arm member 34 has a plurality of splines 34*a* each of which is engaged with the projection 32*b*. A ramp 35 is formed on the rocker arm member 34. A stopper 36 operated by the ramp 35 is engaged with groove 32*c* of the sleeve 32. The sleeve 32 is axially shifted on the shaft 31 to the right by oil pressure and returned by a spring (not shown). When the rocker arm member 34 is rocked by the cam 40, at the same time, the stopper 36 is lifted by the ramp 35 so as to be disengaged from the groove 32*c*.

In operation, as shown in FIG. 12, the stopper 36 is engaged with the groove 32*c*. Although the oil pressure urges the sleeve 32 to shift in the right direction, sleeve 32 maintains the position. When the rocker arm member 34 is rocked and the ramp 35 pushes up the stopper 36, the stopper is disengaged from the groove 32*c*. Thus the sleeve 32 is shifted by oil pressure as shown in FIG. 13. However, in this state, the splines 34*a* of rocker member 34 are not corresponding to the splines 33*a* of actuating arm 33. Accordingly, splines 32*a* of the sleeve 32 can not be engaged with the arm 33. As the cam 40 rotates to engage with the rocker arm member 34 at a base circle 40*a* of the cam 40, the rocker arm member 34 is rocked so as to correspond the splines 34*a* to the splines 33*a*. Thus, as shown in FIG. 14, the projections 32*b* are inserted into the splines 33*a* to integrate the rocker arm 34 with the arm 33, thereby forming a single rocker arm. Accordingly, the valve stem 41 is operated.

In such a mechanism, the engaging operation of the rocker arm member and actuating arm is performed in a synchronized state. However, when the oil is drained, the sleeve is immediately shifted to release the projections from the splines of the actuating arm member 33 by the spring at any time, which will cause the breakdown of splines and projections.

SUMMARY OF THE INVENTION

The object of the present invention is to provide a valve mechanism which may smoothly engage and disengage splines of the actuating arm.

According to the present invention, there is provided a valve mechanism for an automotive engine having a rocker arm comprising a rocker arm member rocked by a cam and an actuating arm member operatively engaged with the rocker arm member for operating a stem of a valve. The mechanism comprises a sleeve rotatably and slidably mounted on a rocker-arm shaft and having splines on a periphery thereof and a cylindrical portion adjacent the splines, the rocker arm member having splines and slidably engaged with the splines of the sleeve, the actuating arm member having splines corresponding to the splines of the sleeve and slidably engaged with the cylindrical portion of the sleeve at a disengagement position, a piston slidably mounted on the rocker-arm shaft adjacent the sleeve, hydraulic means for applying oil to the piston so as to shift the sleeve to an engagement postion to engage the splines thereof with the actuating member, a spring for shifting the sleeve from the engagement position to the disengagement position, stopping means for holding the sleeve at the disengagement postition and the engagement position respectively.

In an aspect of the invention the stopping means comprises a pair of grooves formed on the periphery of the piston, a stopper provided to be selectively engaged with one of the grooves, and a ramp formed on the periphery of the rocker arm member so as to engage and disengage the stopper with and from the groove.

The other objects and features of this invention will be apparently understood from the following description with reference to the accompanying drawings.

DETAILED DESCRIPTION OF THE PREFERRED EMBODIMENTS

Figure 1:
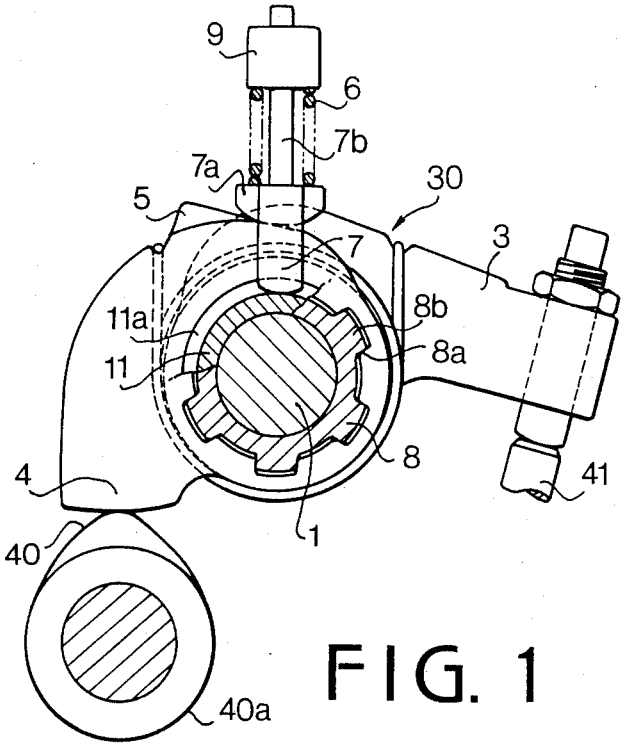
FIG. 1 is a front view of a valve mechanism according to the present invention.
Figure 11:
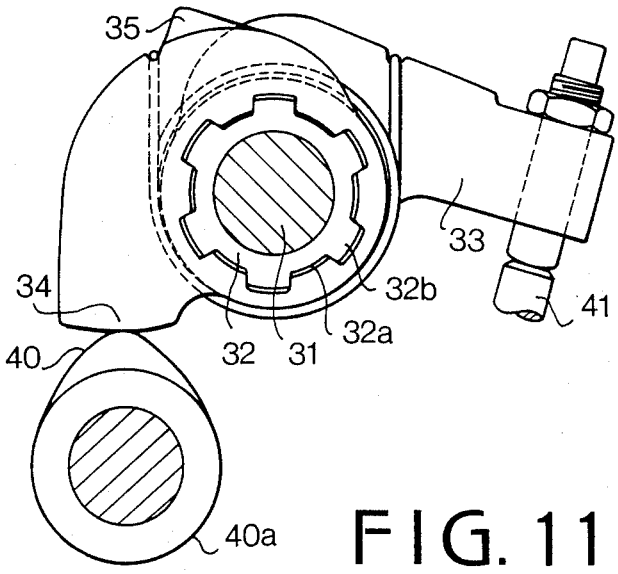
FIG. 11 is a front view of a conventional valve mechanism.
Figure 2:
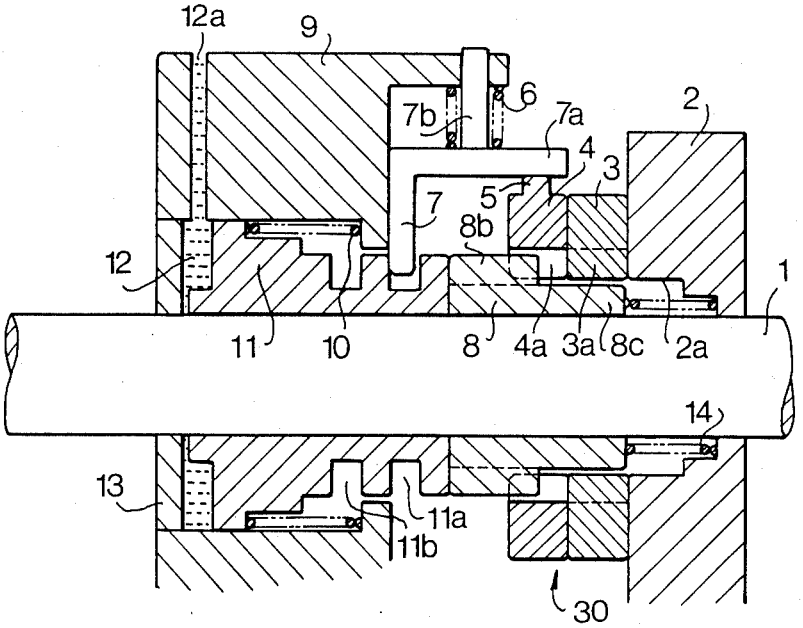
FIGS. 2 to 5 are sectional views showing the operation of the valve mechanism.

Referring to FIGS. 1 and 2, a valve mechanism of the present invention comprises a rocker-arm shaft 1 supported by a shaft holder 2, a sleeve 8 slidably and rotatably mounted on the shaft 1, and a rocker arm 30 rotatably mounted on the shaft 1 through the sleeve 8. The sleeve 8 comprises a spline shaft portion having a plurality of splines 8*a*, projections 8*b*, and a cylindrical portion 8*c*.

The rocker arm 30 consists of two members comprising an actuating arm member 3 engaged with a stem 41 of a valve and a rocker arm member 4 engaged with a cam 40. The actuating arm member 3 is rotatably mounted on the cylindrical portion 8*c* of the sleeve 8. A plurality of splines 3*a* are formed in an internal circumferential portion of the actuating arm member 3 which is mounted on the sleeve 8. The splines 3*a* correspond to the projections 8*b* and is adapted to detachably engage with the projections 8*b*. The actuating arm member 3 is disposed adjacent to the rocker member 4 on the shaft 1. The rocker member 4 has splines 4*a* engaging with projections 8*b* and corresponding to splines 3*a*. The rocker arm member 4 is provided with a ramp 5 integrally formed thereon.

The holder 2 has a hollow 2a formed around the shaft 1, receiving an end portion of the cylindrical portion 8c of the sleeve 8 and a compression spring 14 to bear on the end portion.

Further, as an element for operating the sleeve 8, a hydraulic oil piston 11 housed in a holder 9 is slidably mounted on the shaft 1 in alignment with the sleeve 8. The piston 11 has a pair of engaging grooves 11a and 11b and a compression spring 10.

A stopper 7 slidably supported on holder 9 is detachably engaged with one of grooves 11a and 11b of the piston 11. The stopper 7 has an engaging portion 7a to be engaged with the ramp 5 of the rocker arm member 4 and a vertical rod 7b having a spring 6 urging the engaging portion 7a to the ramp 5. An oil port 12a formed in the holder 9 is communicated with a chamber 12 between the piston 11 and a cap 13 fixed to the shaft 1.

Describing the operation of the valve mechanism, in a valve non-operating state shown in FIG. 2, the projections 8b of the sleeve 8 are partly engaged with the splines 4a of the rocker arm member 4, and splines 3a of the actuating arm member 3 are not engaged with the projections 8b. The stopper 7 is engaged with the groove 11a of the piston 11. In order to provide a valve operating state, oil is supplied to the chamber 12 for the piston 11 through the port 12a. However, the piston 11 is not shifted to the right because of the stopper 7.

Figure 3:
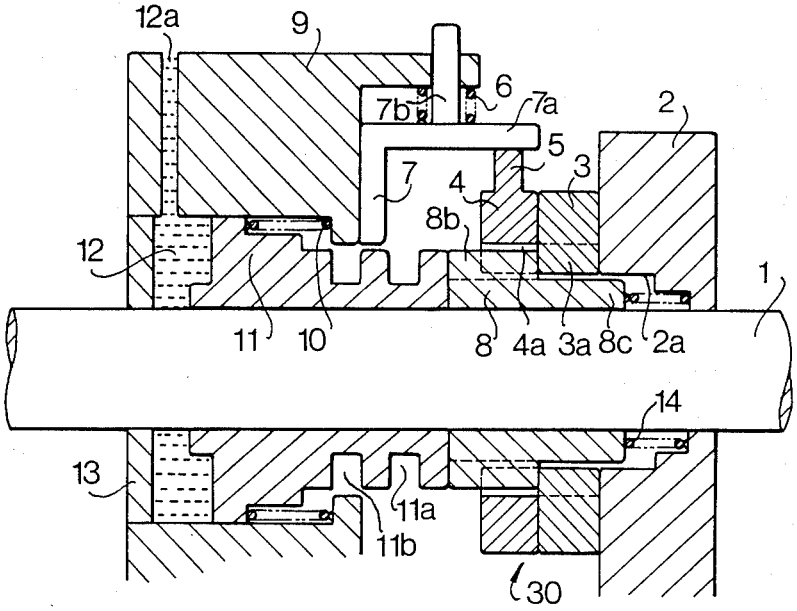

As shown in FIG. 3, when the rocker arm member 4 is rocked by the cam 40 and the ramp 5 engages with the engaging portion 7a to push up the stopper 7 against the spring 6, stopper 7 is retracted from the groove 11a, the piston 11 is shifted by the oil pressure to axially move the sleeve 8 to the right. The projections 8b are entirely engaged with the splines 4a (FIG. 3).

Figure 4:
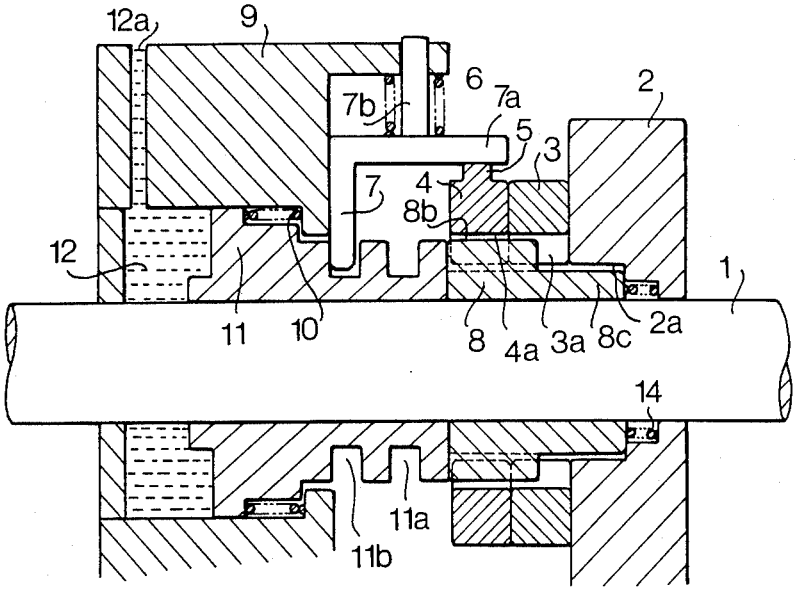

When the rocker arm member 4 engages a base circle 40a of the cam, the splines 4a correspond to the splines 3a. Accordingly, the sleeve 8 is shifted to the right, engaging the projections 8b with the splines 3a and inserting the cylindrical portion of the sleeve 8 into the hollow 2a against the spring 14 as shown in FIG. 4. Accordingly, the rocker arm member 4 is integrated with the actuating arm member 3 to work as the rocker arm 30 for operating the valve. The stopper 7 is vertically reciprocated at the groove 11b.

Figure 5:
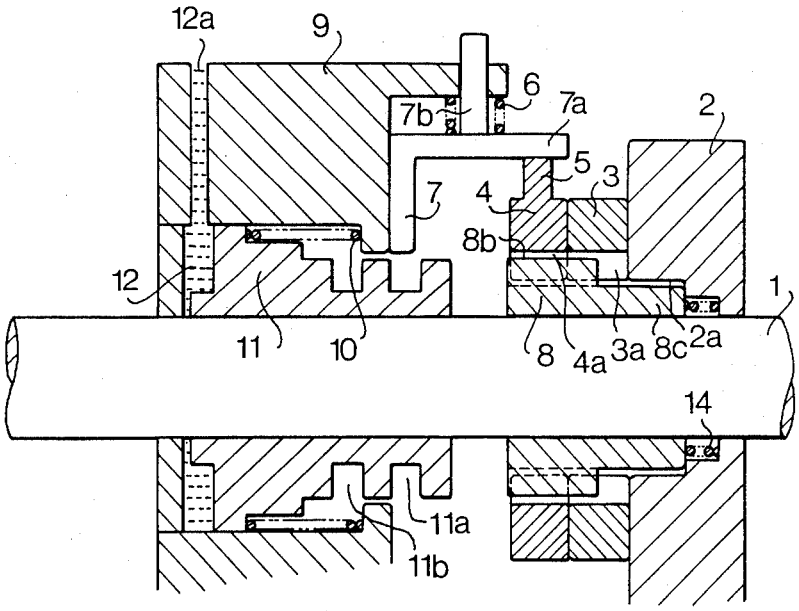
Figure 6:
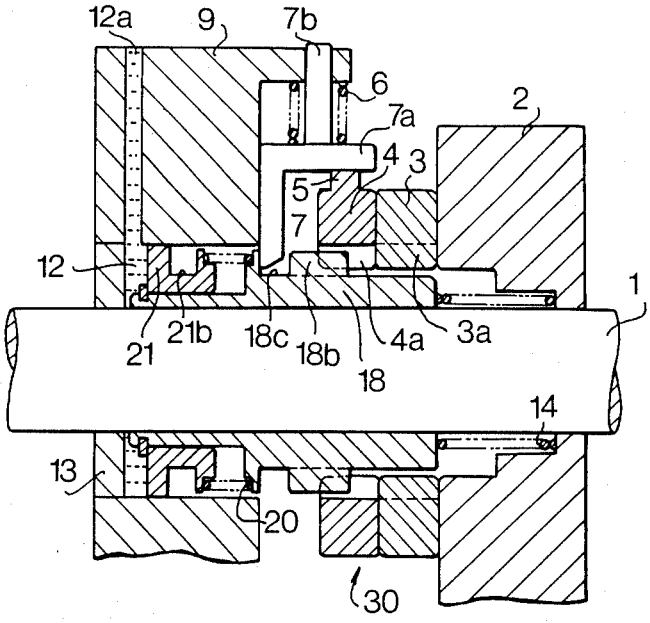
FIGS. 6 to 9 are sectional views showing a modification of the valve mechanism of the present invention.
Figure 7:
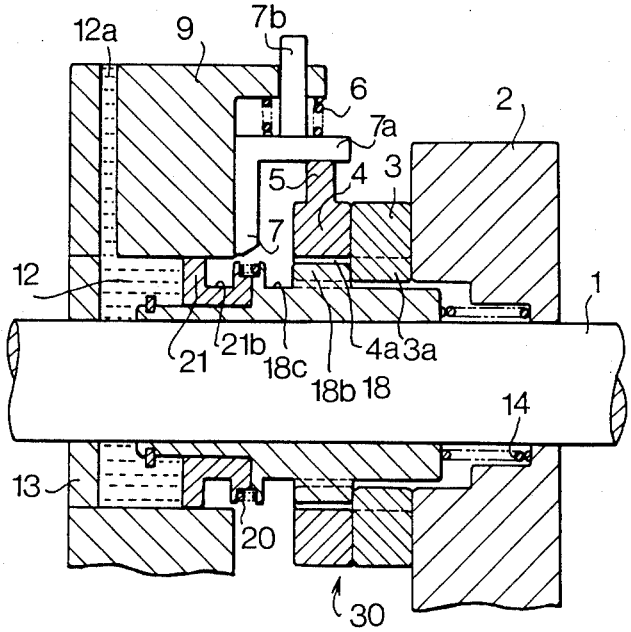
Figure 8:
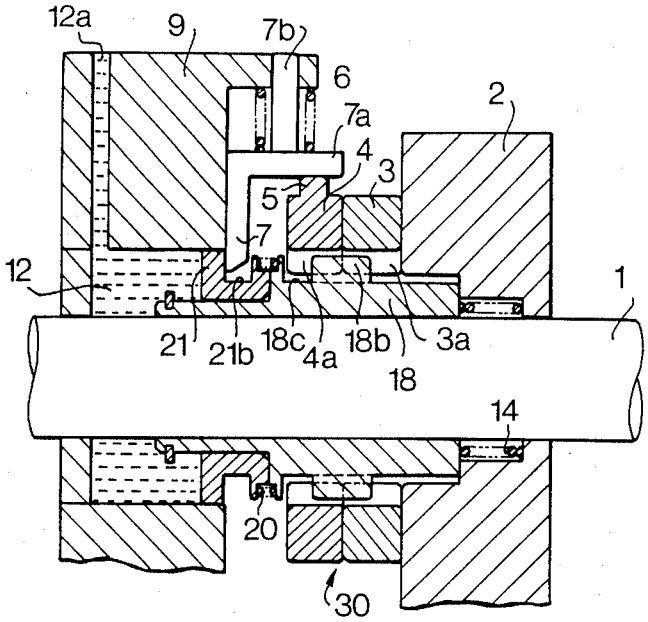
Figure 9:
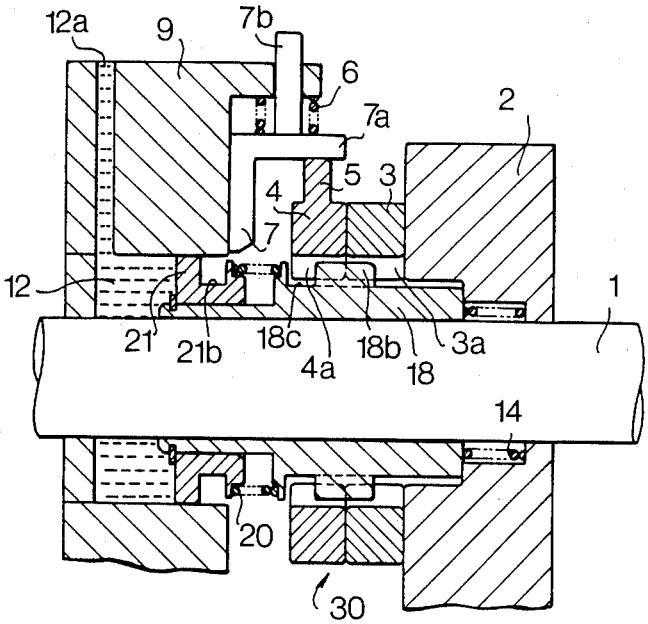

In order to establish the valve non-operating state, the oil is drained from the piston chamber 12 through the port 12a. If the stopper 7 engages with the groove 11b as shown in FIG. 4, the piston 11 stays in the position. By the rock of the rocker arm member 4 after one revolution of the cam, the stopper 7 is disengaged from the groove 11b. Thus, the piston 11 returns to the left by the spring 10 as shown in FIG. 5. However, in this state, the sleeve 8 remains in the position by the friction between splines 3a, 4a of the rocker arm member 4 and actuating arm member 3 and projections 8b. When the base circle 40a of the cam engages with the rocker arm member 4, the friction disappears. The spring 14 urges to move the sleeve 8 to the left to disengage the projections 8b from the splines 3a.

FIGS. 6 to 9 show a modification of the valve mechanism of the present invention. A sleeve 18 is disposed on the shaft 1 covering the shaft between the cap 13 and the shaft holder 2. The sleeve 18 has a spline shaft portion and end cylindrical portions formed opposite sides of the spline shaft portion. An engaging groove 18c for the stopper 7 is formed adjacent to splines 18b. A piston 21 is mounted on the left cylindrical portion of the sleeve 18. The piston 21 is urged by a spring 20 disposed between the piston 21 and the sleeve 18 and has another engaging groove 21b for the stopper 7. The same parts as the previous embodiment are identified with the same reference numerals as FIGS. 1 to 5. As shown in FIGS. 6 to 9, the mechanism operates in the the same manner as the previous embodiment.

Figure 10:
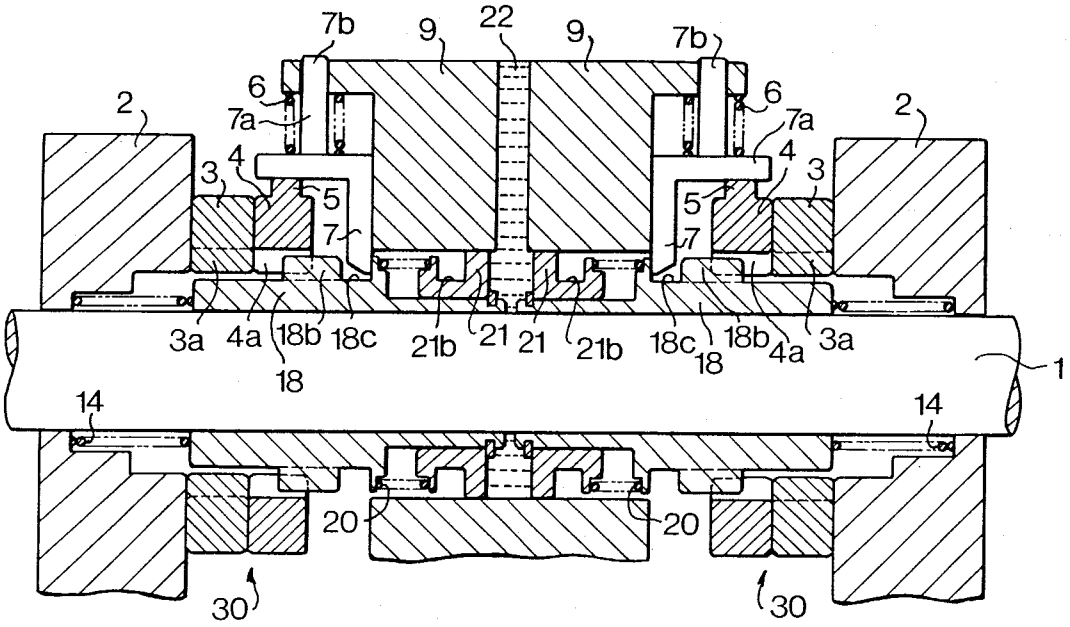
FIG. 10 is a sectional view of another modification.
Figure 12:
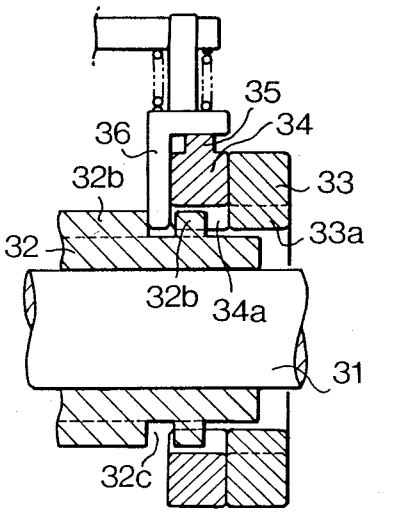
FIGS. 12 to 14 are sectional views showing the operation of the conventional mechanism.
Figure 13:
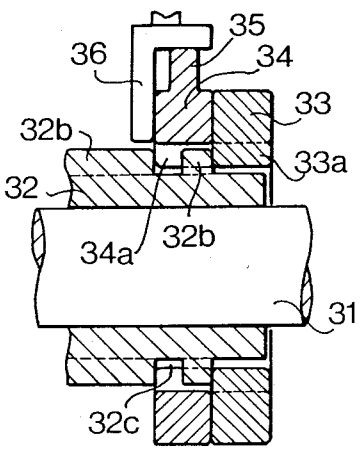
Figure 14:
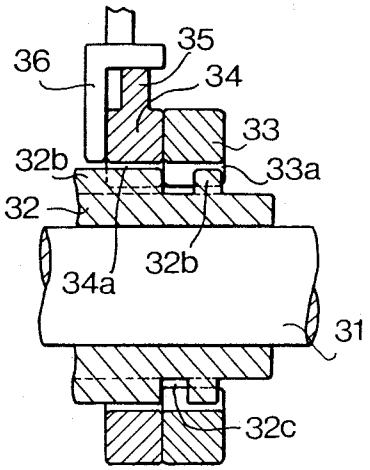

FIG. 10 shows another modification, in which the unit of the valve mechanism shown in FIGS. 6 to 9 is symmetrically disposed on the shaft 1 between shaft holders 2. A common oil port 22 is provided.

According to the present invention, when the valve operating state is changed to the valve non-operating state, the timing of disengagement of the actuating arm member from the rocker arm member is synchronized with the cam operation. Therefore, the disengagement of the actuating arm member is smoothly achieved without breakdown of splines.

While the presently referred embodiment of the present invention has been shown and described, it is to be understood that this disclosure is for the purpose of illustration and that various changes and modifications may be made without departing from the spirit and scope of the invention as set forth in the appended claim.

What is claimed is:

1. A valve mechanism for an automotive engine having a rocker arm comprising a rocker arm member rocked by a cam and an actuating arm member operatively engaged with the rocker arm member for operating a stem of a valve, the mechanism comprising:

a sleeve rotatably and slidably mounted on a rocker-arm shaft and having splines on a periphery thereof and a cylindrical portion adjacent the splines;

the rocker arm member having splines and slidably engaged with the splines of the sleeve;

the actuating arm member having splines corresponding to the splines of the sleeve and slidably engaged with the cylindrical portion of the sleeve at a disengagement position;

a piston slidably mounted on the rocker-arm shaft adjacent the sleeve;

hydraulic means for applying oil to the piston so as to shift the sleeve to an engagement position to engage the splines thereof with the actuating arm member;

a spring provided between the cylindrical portion and a shaft holder for shifting the sleeve from the engagement position to the disengagement position; and stopping means for holding the sleeve at the disengagement position and the engagement position respectively.

2. The valve mechanism according to claim 1 wherein the stopping means comprises a pair of grooves formed on the periphery of the piston, a stopper provided to be selectively engaged with one of the grooves, and a ramp formed on the periphery of the rocker arm member so as to engage and disengage the stopper with and from the groove.

3. The valve mechanism according to claim 2 wherein one of the grooves is formed on the sleeve.

4. The valve mechanism according to claim 2 wherein the cam has a base circle, the splines of the rocker arm member are so arranged that when the rocker arm member engages with the base circle, the splines correspond to the splines of the actuating arm member.

* * * * *